US010834965B2

(12) United States Patent
Zhu

(10) Patent No.: US 10,834,965 B2
(45) **Date of Patent: *Nov. 17, 2020**

(54) CERAMIC VAPORIZER AND ELECTRONIC CIGARETTES HAVING THE CERAMIC VAPORIZER

(71) Applicant: SHENZHEN KANGER TECHNOLOGY CO., LTD, Shenzhen (CN)

(72) Inventor: Xiaochun Zhu, Shenzhen (CN)

(73) Assignee: SHENZHEN KANGER TECHNOLOGY CO., LTD., Shenzhen (CN)

( * ) Notice: Subject to any disclaimer, the term of this patent is extended or adjusted under 35 U.S.C. 154(b) by 101 days.

This patent is subject to a terminal disclaimer.

(21) Appl. No.: 14/906,565

(22) PCT Filed: Jan. 20, 2016

(86) PCT No.: PCT/CN2016/071499

§ 371 (c)(1),
(2) Date: Jan. 21, 2016

(87) PCT Pub. No.: WO2017/124334

PCT Pub. Date: Jul. 27, 2017

(65) Prior Publication Data

US 2018/0310615 A1 Nov. 1, 2018

(51) Int. Cl.
*A24F 47/00* (2020.01)
*A24F 7/00* (2006.01)
(Continued)

(52) U.S. Cl.
CPC ..... *A24F 47/008* (2013.01); *A24F 7/00* (2013.01); *H05B 3/18* (2013.01); *H05B 3/48* (2013.01);
(Continued)

(58) Field of Classification Search
None
See application file for complete search history.

(56) References Cited

U.S. PATENT DOCUMENTS

2016/0235121 A1* 8/2016 Rogan ..... A24D 3/041
2017/0049153 A1* 2/2017 Guo ..... A24F 47/008
(Continued)

*Primary Examiner* — Michael H. Wilson
*Assistant Examiner* — Katherine A Will
(74) *Attorney, Agent, or Firm* — Ming Jiang; MM IP Services, LLC

(57) ABSTRACT

Certain aspects of present invention relate to a ceramic vaporizer for electronic cigarette and electronic cigarettes having the ceramic vaporizer. In certain embodiments, the ceramic vaporizer may include a cylindrical vaporizer body, and a vaporizer heater. The cylindrical vaporizer body has an interior surface, and an exterior surface. The interior surface forms a central vapor passage and the exterior surface forms an inside wall of an e-liquid storage device. The vaporizer heater is embedded inside the cylindrical vaporizer body. The vaporizer heater may include one or more heating elements configured to heat e-liquid stored in e-liquid storage device and e-liquid is in direct contact with exterior surface of the cylindrical vaporizer body. The one or more heating elements may include certain electrothermal alloys. In certain embodiments, the one or more heating elements may include one or more mesh heating elements, and one or more spiral heating elements.

18 Claims, 5 Drawing Sheets

(51) Int. Cl.
*H05B 3/18* (2006.01)
*H05B 3/48* (2006.01)

(52) U.S. Cl.
CPC .. *H05B 2203/002* (2013.01); *H05B 2203/003* (2013.01); *H05B 2203/021* (2013.01)

(56) References Cited

U.S. PATENT DOCUMENTS

2017/0181471 A1* 6/2017 Phillips ..... H02J 7/0029
2017/0295847 A1* 10/2017 Liu ..... A24F 47/00
2018/0184714 A1* 7/2018 Liu ..... A24F 47/008

* cited by examiner

CERAMIC VAPORIZER AND ELECTRONIC CIGARETTES HAVING THE CERAMIC VAPORIZER

FIELD

The present invention generally relates to the field of electronic cigarette, and more particularly to ceramic vaporizers and electronic cigarettes having the ceramic vaporizers.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes are made with a mouthpiece assembly, a vaporizer assembly, an electric connecting assembly, and an e-liquid storage assembly. The mouthpiece is installed on top of the e-liquid storage assembly, and the vaporizer assembly is installed inside of the e-liquid storage assembly, and electrically connected to a DC power source through the electric connecting assembly. The mouthpiece assembly is connected to the vaporizer assembly and forms an air flow passage. The e-liquid is stored in the e-liquid storage assembly. The e-liquid flows through a vaporizing chamber of the heating assembly using fiber threads. The e-liquid in the fiber threads is then heated by a heating wire of the heating assembly and therefore vaporized. The vaporized e-liquid goes up to the mouthpiece such that a smoker enjoys the vaporized e-liquid. However, when e-liquid makes direct contact with the heating element, it may cause certain burning smell that negatively impact user experiences.

Therefore, an unaddressed need exists in the art to address the aforementioned deficiencies and inadequacies.

SUMMARY

In one aspect, the present invention relates to a ceramic vaporizer for electronic cigarette. In certain embodiments, the ceramic vaporizer may include a cylindrical vaporizer body, and a vaporizer heater. The cylindrical vaporizer body has an interior surface, and an exterior surface. The interior surface forms a central vapor passage and the exterior surface forms an inside wall of an e-liquid storage device. The vaporizer heater is embedded inside the cylindrical vaporizer body.

In certain embodiments, the vaporizer heater may include one or more heating elements. The one or more heating elements are configured to heat e-liquid stored in the e-liquid storage device and the e-liquid is in direct contact with the exterior surface of the cylindrical vaporizer body.

In certain embodiments, the one or more heating elements may include: Aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these elements.

In certain embodiments, the one or more heating elements may include one or more mesh heating elements, and one or more spiral heating elements.

In certain embodiments, each of the one or more heating elements may include a first electrical input terminal configured to connect to a first terminal of a power supply of an electronic cigarette, and a second electrical input terminal configured to connect to a second terminal of the power supply of electronic cigarette.

In one embodiment, the e-liquid storage device may include an e-liquid storage tank positioned outside of the exterior surface. In another embodiment, the e-liquid storage device may include a cylindrical e-liquid storage medium positioned outside of the exterior surface. The cylindrical e-liquid storage medium may include cotton fibers, polypropylene fibers, terylene fibers, nylon fibers, and porous ceramic materials.

In certain embodiments, the present invention relates to an electronic cigarette having the ceramic vaporizer described above.

In another aspect, the present invention relates to an electronic cigarette having a ceramic vaporizer. In certain embodiments, the ceramic vaporizer may include a cylindrical vaporizer body, and a vaporizer heater. The cylindrical vaporizer body may include an interior surface, and an exterior surface. The interior surface forms a central vapor passage, and the exterior surface forms an inside wall of an e-liquid storage device. The vaporizer heater is embedded inside the cylindrical vaporizer body.

In certain embodiments, the vaporizer heater may include one or more heating elements. The one or more heating elements are configured to heat e-liquid stored in the e-liquid storage device and the e-liquid is in direct contact with the exterior surface of the cylindrical vaporizer body.

In certain embodiments, the one or more heating elements may include Aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these elements.

In certain embodiments, the one or more heating elements may include one or more mesh heating elements, and one or more spiral heating elements.

In certain embodiments, each of the one or more heating elements may include a first electrical input terminal configured to connect to a first terminal of a power supply of the electronic cigarette, and a second electrical input terminal configured to connect to a second terminal of the power supply of electronic cigarette.

In certain embodiments, the electronic cigarette may include an air adjustment assembly. The air adjustment assembly may include an air adjustment assembly base, an air adjustment ring, and a sealing ring. The air adjustment assembly base may include an upper tubular portion threadedly connected to a lower outside threaded portion of the ceramic vaporizer. An air adjustment chamber is defined inside of the air adjustment assembly base. The air adjustment chamber may include a predetermined number of first air vents provided to supply air from outside to inside of the air adjustment chamber. The air adjustment ring is positioned outside of the upper tubular portion of the air adjustment assembly base. The air adjustment ring may include a predetermined number of second air vents. The sealing ring is configured to prevent air leak from the air adjustment chamber.

In certain embodiments, when a user rotates the air adjustment ring around the upper tubular portion of the air adjustment assembly base, and when the locations of the second air vents of the air adjustment ring match the locations of the first air vents, air flow from outside to the air adjustment chamber reaches maximum capacity. When the user further rotates the air adjustment ring around the upper tubular portion, the air flow decreases. When the locations of the second air vents of the air adjustment ring completely misalign with the locations of the first air vents, the air flow stops.

In certain embodiments, the electronic cigarette may also include an electric connector assembly. The electric connector assembly may include an electric connector base, an electrode, and an insulation cover. The electric connector base is attached to the air adjustment assembly and adapted for connecting the electric power supply to the one or more heating elements of the ceramic vaporizer. The electric connector base may include an outer thread configured to electrically connect the first terminal of the power supply of the electronic cigarette to the first electrical input terminal of the one or more heating elements. The electrode is configured to electrically connect the second terminal of the power supply to the second electrical input terminal of one or more heating elements. The insulation cover is positioned between the electric connector base and the electrode to provide insulation between the first terminal and the second terminal of the power supply of the electronic cigarette.

In one embodiment, the electronic cigarette may also include an electric power switch configured to allow the user to turn on and off the power supply to the electronic cigarette.

In certain embodiments, the electronic cigarette may also include an electric power adjustment device. The electric power adjustment device may allow the user to adjust the electric power to control vaporization of the e-liquid.

In certain embodiments, the e-liquid storage device may include an e-liquid storage tank positioned outside of the exterior surface of the ceramic vaporizer. In another embodiment, the e-liquid storage device may include a cylindrical e-liquid storage medium positioned outside of the exterior surface. The cylindrical e-liquid storage medium may include cotton fibers, polypropylene fibers, terylene fibers, nylon fibers, and porous ceramic materials.

In certain embodiments, the electronic cigarette may also include a mouthpiece assembly. The mouth piece assembly may include a mouthpiece, a mouthpiece connector, and a mouthpiece sealing ring. The mouthpiece may include a hollow center air passage connected to the central vapor passage of the ceramic vaporizer. The hollow center air passage is configured to provide vaporized e-liquid to a user. The mouthpiece connector may include a threaded lower portion threadedly connected to a ceramic vaporizer body support. The mouthpiece sealing ring is configured to prevent the vaporized e-liquid to leak from the mouthpiece connector.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
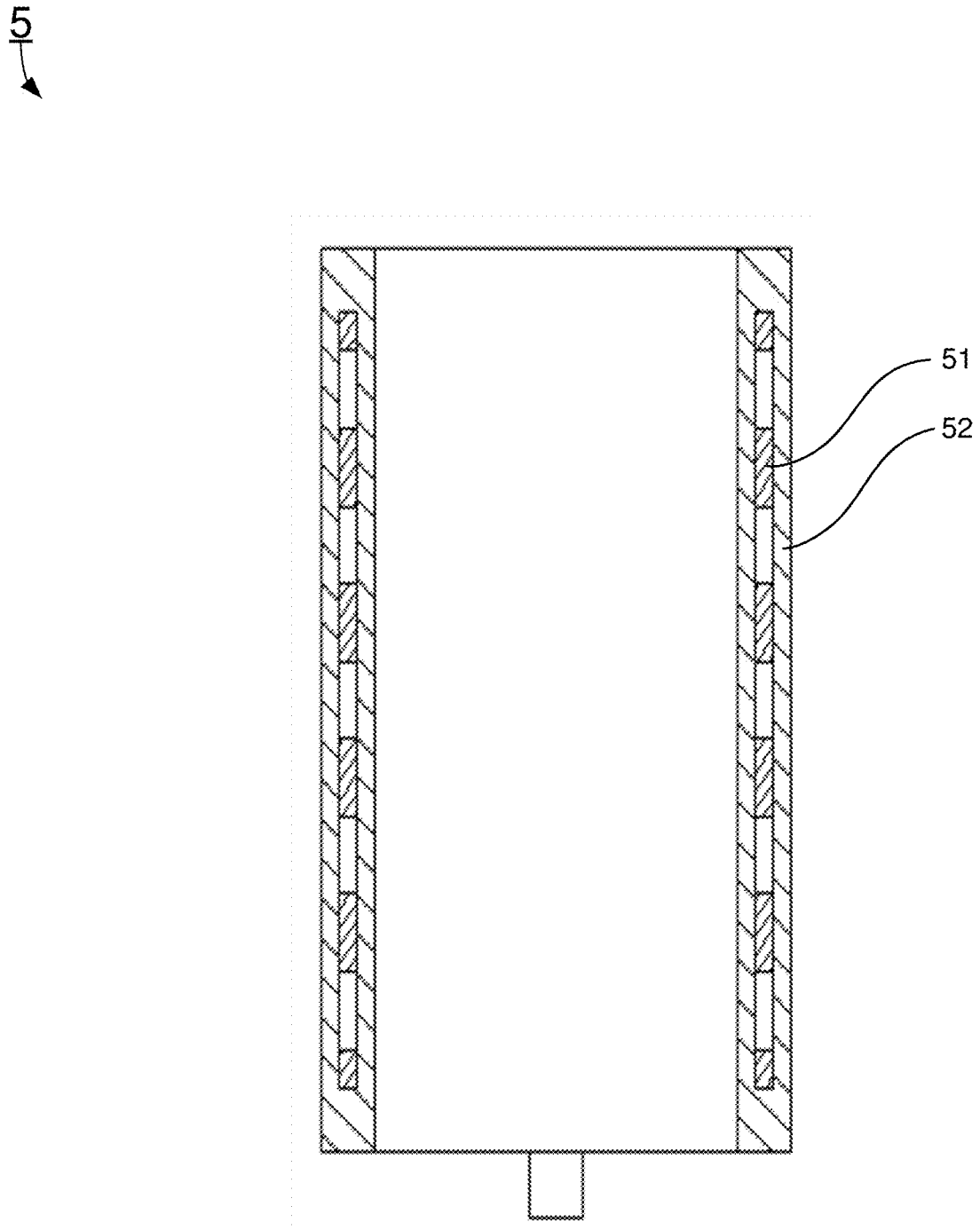
FIG. 1 is a cross-sectional view of a ceramic vaporizer according to certain embodiments of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

The description will be made as to the embodiments of the present invention in conjunction with the accompanying drawings FIGS. 1 through 5. In accordance with the purposes of this invention, as embodied and broadly described herein, this invention, in one aspect, relates to a ceramic vaporizer 5 for electronic cigarettes.

In one aspect, the present invention relates to a ceramic vaporizer 5 for electronic cigarette. Referring now to FIG. 1, a cross-sectional view of a ceramic vaporizer 5 is shown according to certain embodiments of the present invention. The ceramic vaporizer 5 may include a cylindrical vaporizer body 52, and a vaporizer heater 51. The cylindrical vaporizer body 52 has an interior surface, and an exterior surface. The interior surface forms a central vapor passage and the exterior surface forms an inside wall of an e-liquid storage device. The ceramic vaporizer 5 is made of high quality ceramic material. It have very strong and durable surface. The vaporizer heater 51 is embedded inside the cylindrical vaporizer body 52. In certain embodiments, the vaporizer heater 51 may include one or more heating elements. The one or more heating elements are configured to heat e-liquid stored in the e-liquid storage device and the e-liquid is in direct contact with the exterior surface of the cylindrical vaporizer body 52. The e-liquid is heated through the exterior surface of the ceramic vaporizer 5. This configuration avoid direct contact between e-liquid and heating elements and it may prevent burning smell when the e-liquid makes direct contact with the heating elements. The one or more heating elements are totally covered by the ceramic material and therefore it is safe and may prevent short circuit. The ceramic vaporizer 5 is formed in much higher temperature than it is actually used in the electronic cigarette, therefore it is safe to use. The heat is transferred evenly on the surface of the ceramic vaporizer 5. On one hand, the heating elements heat the ceramic vaporizer quickly. On the other hand, the ceramic vaporizer 5 may be cooled quickly as well. The heating elements are not exposed to air so that the heating elements are prevented from oxidation. This configuration also prolongs the life of the ceramic vaporizer 5 and its heating elements.

In certain embodiments, the one or more heating elements may include: Aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these elements.

In certain embodiments, the one or more heating elements may include certain electrothermal alloys such as Nickel Chromium alloys, OCr25AL5, OCr27AL7MO2, OCr21AL6Nb, Cr15Ni60, Cr20Ni80, and Ocr19AL3 etc.

In one embodiment, the one or more heating elements may include heating wires wounded in mesh form. In another embodiment, the one or more heating elements may include heating wires wounded in spiral form.

In certain embodiments, each of the one or more heating elements may include a first electrical input terminal configured to connect to a first terminal of a power supply of an electronic cigarette, and a second electrical input terminal configured to connect to a second terminal of the power supply of electronic cigarette.

Figure 2:
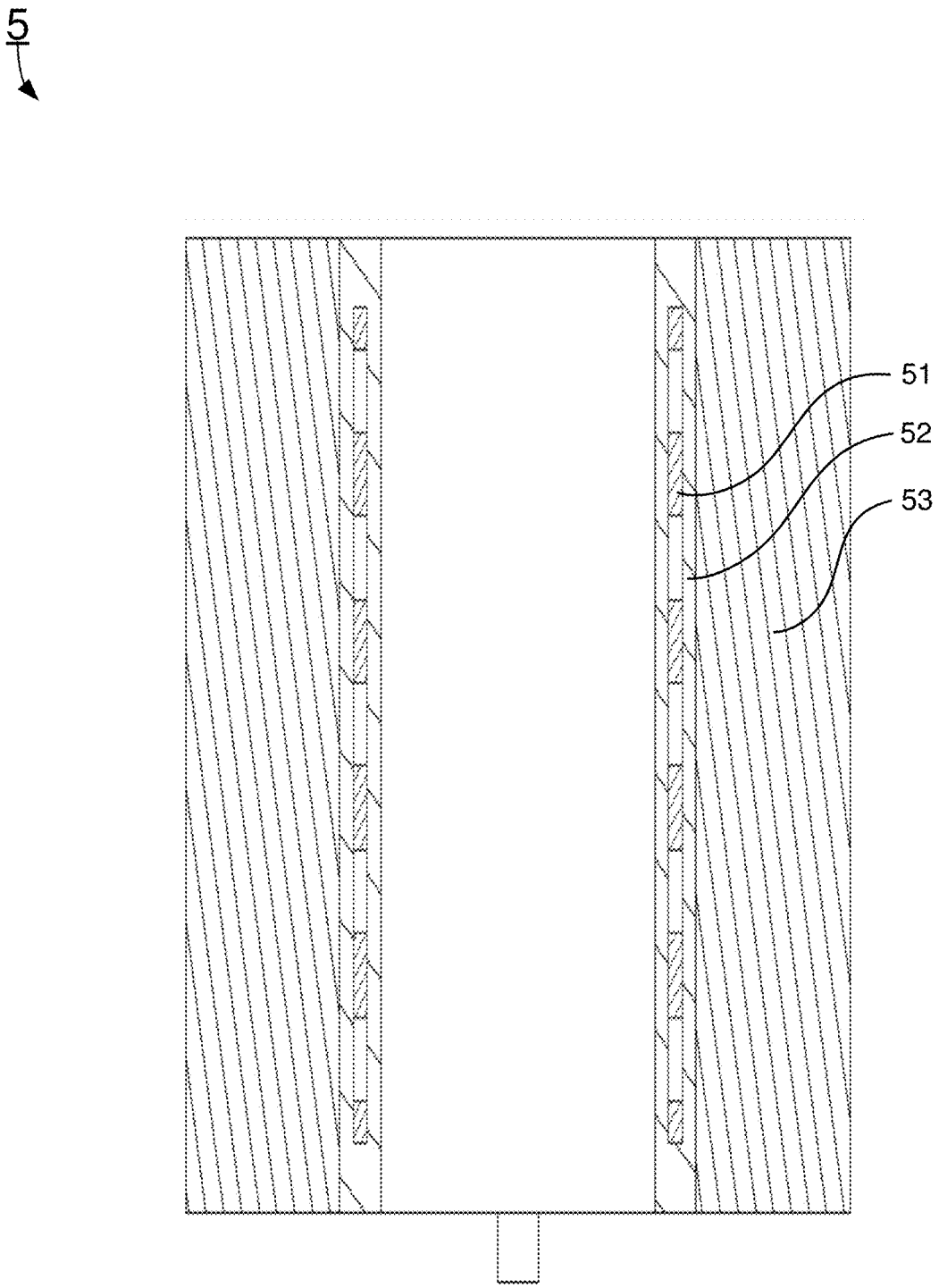
FIG. 2 is a cross-sectional view of another ceramic vaporizer having a cylindrical e-liquid storage medium according to certain embodiments of the present invention.

In one embodiment, the e-liquid storage device may include an e-liquid storage tank positioned outside of the exterior surface. In another embodiment, the e-liquid storage device may include a cylindrical e-liquid storage medium 53 positioned outside of the exterior surface, as shown in FIG. 2. The cylindrical e-liquid storage medium 53 may include cotton fibers, polypropylene fibers, terylene fibers, nylon fibers, and porous ceramic materials.

In certain embodiments, the present invention relates to an electronic cigarette having the ceramic vaporizer described above.

Figure 3:
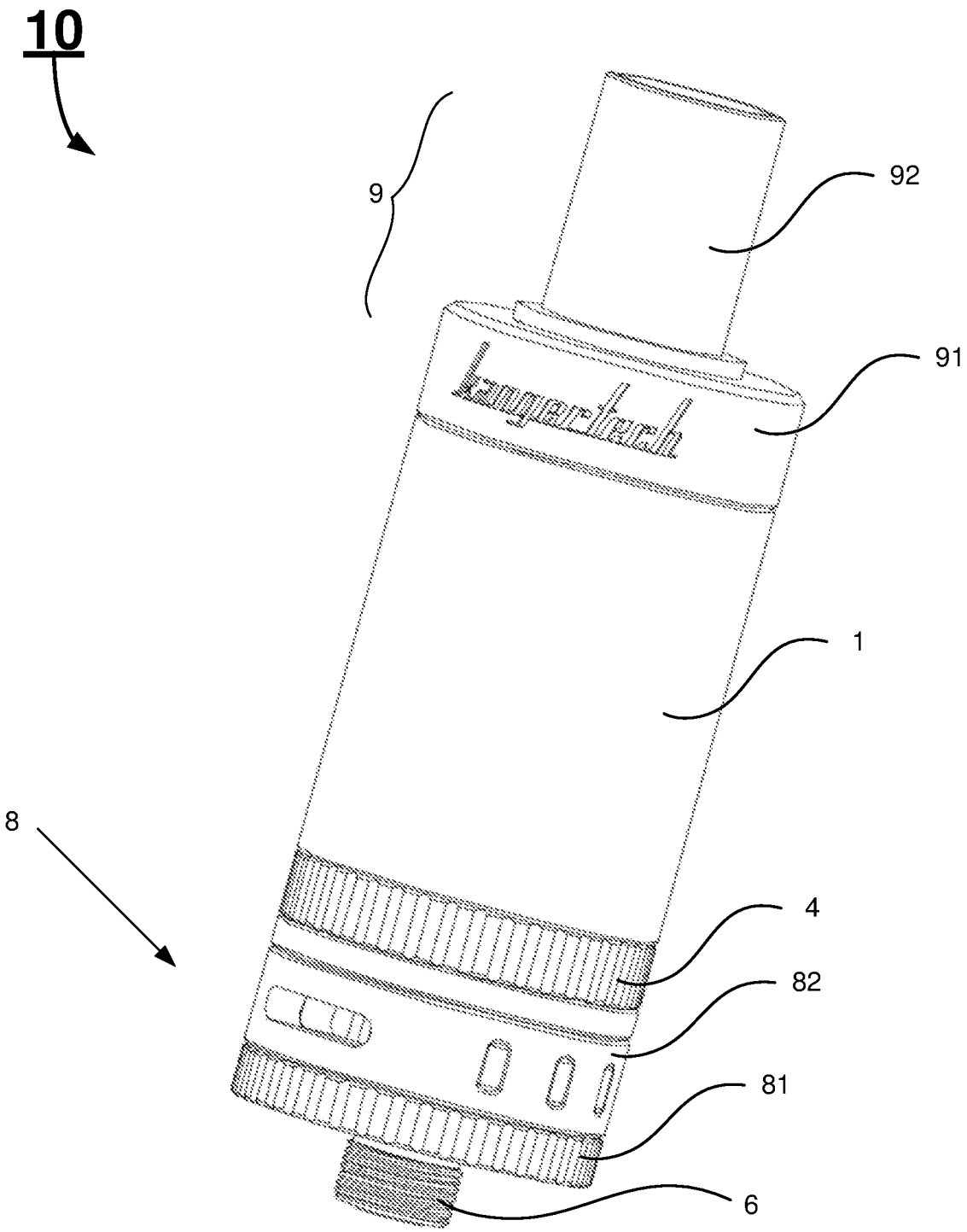
FIG. 3 is a perspective view of an electronic cigarette having a ceramic vaporizer according to certain embodiments of the present invention.
Figure 4:
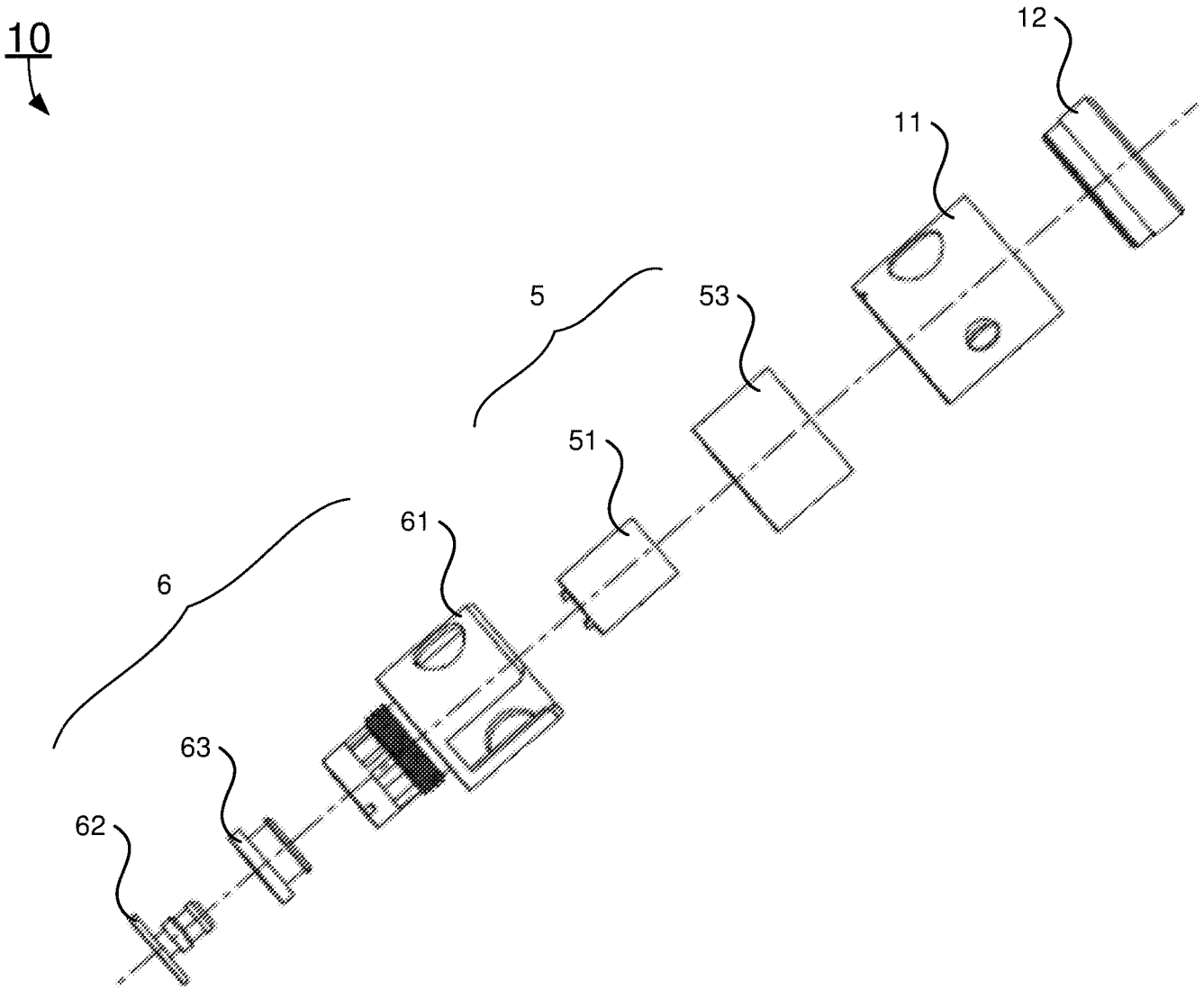
FIG. 4 is an exploded view of the electronic cigarette having the ceramic vaporizer as shown in FIG. 3 according to certain embodiments of the present invention.
Figure 5:
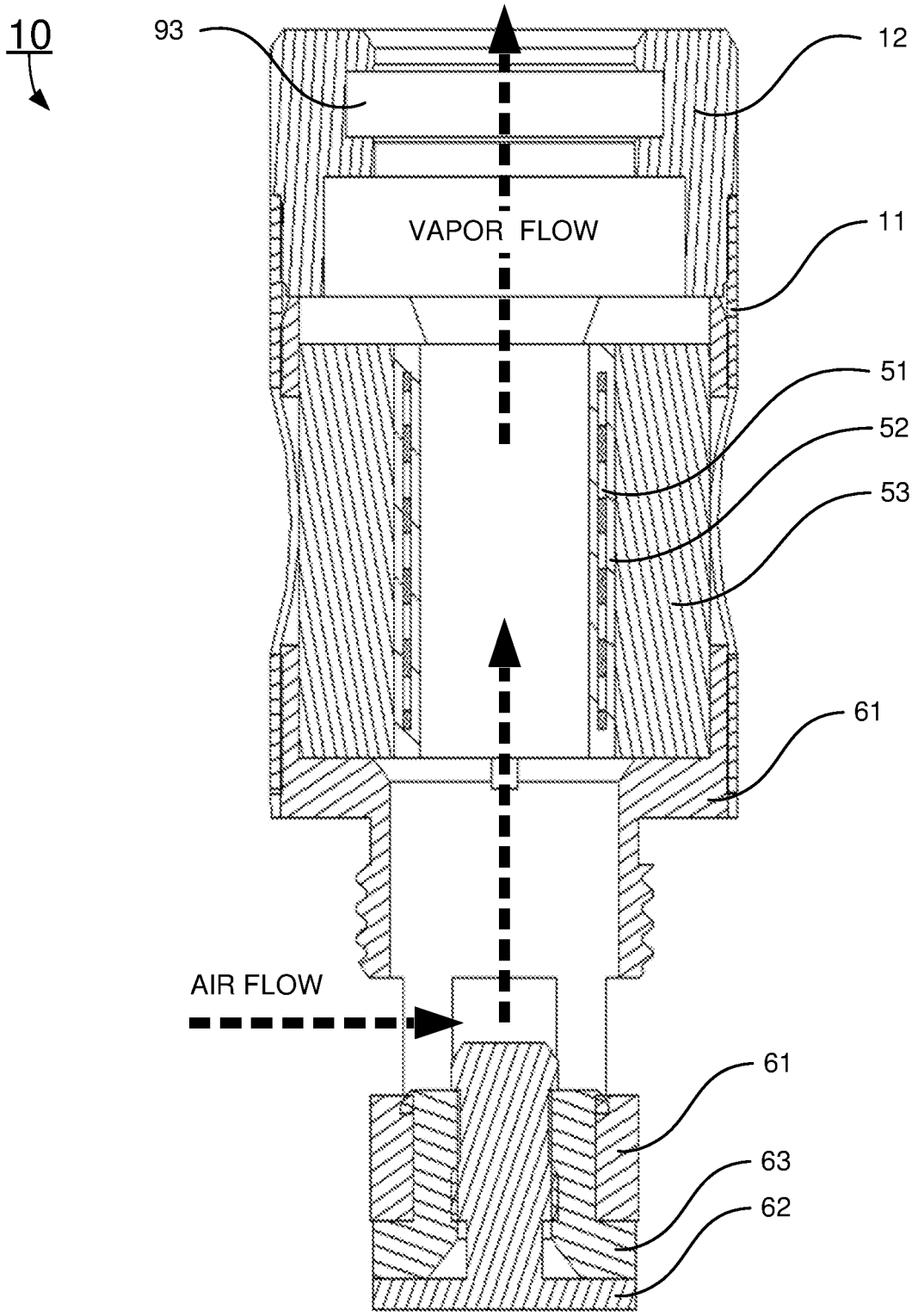
FIG. 5 is a cross-sectional view of the electronic cigarette having the ceramic vaporizer as shown in FIG. 3 according to certain embodiments of the present invention.

In another aspect, the present invention relates to an electronic cigarette 10 having a ceramic vaporizer 5. Referring now to FIGS. 3, 4, and 5, a perspective view, an exploded view and a cross-sectional view of the electronic cigarette 10 having the ceramic vaporizer 5 are shown, respectively, according to certain embodiments of the present invention. The electronic cigarette 10 may include a mouthpiece assembly 9, an electronic cigarette body 1, a lower portion 4 of the ceramic vaporizer 5, an air adjustment assembly 8, and an electric connector assembly 6. In certain embodiments, the mouthpiece assembly 9 may be removed to refill e-liquid to e-liquid storage of the electronic cigarette 10. The electronic cigarette body 1 may include a top cover 12, and a tubular electronic cigarette body 11. In certain embodiments, the tubular electronic cigarette body 11 may define one or more openings to allow a user to observe level of e-liquid inside of an e-liquid storage device.

In certain embodiments, the electronic cigarette 10 includes the ceramic vaporizer 5. The ceramic vaporizer 5 may include a cylindrical vaporizer body 52, and a vaporizer heater 51. The cylindrical vaporizer body 52 may include an interior surface, and an exterior surface. The interior surface forms a central vapor passage, and the exterior surface forms an inside wall of an e-liquid storage device. The vaporizer heater 51 is embedded inside the cylindrical vaporizer body.

In certain embodiments, the vaporizer heater 51 may include one or more heating elements. The one or more heating elements are configured to heat e-liquid stored in the e-liquid storage device and the e-liquid is in direct contact with the exterior surface of the cylindrical vaporizer body 52.

In certain embodiments, the one or more heating elements may include Aluminum (Al), Chromium (Cr), Manganese (Mn), Iron (Fe), Cobalt (Co), Nickel (Ni), Copper (Cu), Zirconium (Zr), Niobium (Nb), Molybdenur (Mo), Rhenium (Re), Silver (Ag), Cadmium (Cd), Tantalum (Ta), Tungsten (W), Iridium (Ir), Platinum (Pt), Gold (Au), and alloys of these elements.

In certain embodiments, the one or more heating elements may include one or more mesh heating elements, and one or more spiral heating elements.

In certain embodiments, each of the one or more heating elements may include a first electrical input terminal configured to connect to a first terminal of a power supply of the electronic cigarette, and a second electrical input terminal configured to connect to a second terminal of the power supply of electronic cigarette.

In certain embodiments, the electronic cigarette 10 may also include a mouthpiece assembly 9. The mouth piece assembly 9 includes a mouthpiece 92, a mouthpiece connector 91, as shown in FIG. 3, and a mouthpiece sealing ring 93 as shown in FIG. 5. The mouthpiece includes a hollow center air passage connected to the central vapor passage of the ceramic vaporizer 5. The hollow center air passage is configured to provide vaporized e-liquid to a user. The mouthpiece connector 93 includes a threaded lower portion threadedly connected to a ceramic vaporizer body support. The mouthpiece sealing ring 93 is configured to prevent the vaporized e-liquid to leak from the mouthpiece connector 91.

In certain embodiments, the electronic cigarette 10 may include an air adjustment assembly 8. The air adjustment assembly 8 includes, as shown in FIG. 3, an air adjustment assembly base 81, an air adjustment ring 82, and a sealing ring (not shown in FIG. 3). The air adjustment assembly base 81 may include an upper tubular portion threadedly connected to a lower outside threaded portion of the ceramic vaporizer 5. An air adjustment chamber is defined inside of the air adjustment assembly base 81. The air adjustment chamber may include a predetermined number of first air vents provided to supply air from outside to inside of the air adjustment chamber. The air adjustment ring 82 is positioned outside of the upper tubular portion of the air adjustment assembly base 81. The air adjustment ring 82 may include a predetermined number of second air vents. The sealing ring is configured to prevent air leak from the air adjustment chamber.

When a user rotates the air adjustment ring around the upper tubular portion of the air adjustment assembly base, and when the locations of the second air vents of the air adjustment ring match the locations of the first air vents, air flow from outside to the air adjustment chamber reaches maximum capacity as indicated by a dashed arrow in FIG. 5. The air inside the air adjustment chamber may flow upwards when the user sucks air through the mouthpiece assembly 9 as indicated by the upward arrow in FIG. 5. When the air pass through the central vapor passage, the air becomes vapor and the vapor flows upward to the user through the mouthpiece assembly 9. When the user further rotates the air adjustment ring around the upper tubular portion, the air flow decreases. When the locations of the second air vents of the air adjustment ring completely misalign with the locations of the first air vents, the air flow stops.

In certain embodiments, the electronic cigarette 10 may also include an electric connector assembly 6. The electric connector assembly 6 may include an electric connector base 61, an electrode 62, and an insulation cover 53, as shown in FIGS. 4 and 5. The electric connector base is attached to the air adjustment assembly 8 and adapted for connecting the electric power supply to the one or more heating elements of the ceramic vaporizer 5. The electric connector base may include an outer thread configured to electrically connect the first terminal of the power supply of the electronic cigarette to the first electrical input terminal of the one or more heating elements. The electrode is configured to electrically connect the second terminal of the power supply to the second electrical input terminal of one or more heating elements. The insulation cover is positioned between the electric connector base and the electrode to provide insulation between the first terminal and the second terminal of the power supply of the electronic cigarette.

In one embodiment, the electronic cigarette 10 may also include an electric power switch configured to allow the user to turn on and off the power supply to the electronic cigarette.

In certain embodiments, the electronic cigarette 10 may also include an electric power adjustment device. The electric power adjustment device may allow the user to adjust the electric power to control vaporization of the e-liquid.

In certain embodiments, the e-liquid storage device may include an e-liquid storage tank positioned outside of the exterior surface of the ceramic vaporizer. In another embodiment, the e-liquid storage device may include a cylindrical e-liquid storage medium 53 positioned outside of the exterior surface as shown in FIGS. 4 and 5. The cylindrical e-liquid storage medium 53 may include cotton fibers, polypropylene fibers, terylene fibers, nylon fibers, and porous ceramic materials.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A ceramic vaporizer comprising:

a cylindrical vaporizer body having an interior surface, and an exterior surface, wherein the interior surface forms a central vapor passage, and the exterior surface forms an inside wall of an e-liquid storage device, wherein the cylindrical vaporizer body extends the entire length of the e-liquid storage device; and a vaporizer heater coaxially positioned in the center of the cylindrical vaporizer body between the interior surface and the exterior surface of the cylindrical vaporizer body.

2. The ceramic vaporizer of claim 1, wherein the vaporizer heater comprises one or more heating elements configured to heat e-liquid in direct contact with the exterior surface of the cylindrical vaporizer body.

3. The ceramic vaporizer of claim 2, wherein the one or more heating elements comprise at least one of:

aluminum (Al);
Chromium (Cr);
Manganese (Mn);
Iron (Fe);
Cobalt (Co);
Nickel (Ni);
Copper (Cu);
Zirconium (Zr);
Niobium (Nb);
Molybdenur (Mo);
Rhenium (Re);
Silver (Ag);
Cadmium (Cd);
Tantalum (Ta);
Tungsten (W);
Iridium (Ir);
Platinum (Pt);
Gold (Au); and
alloys thereof.

4. The ceramic vaporizer of claim 2, wherein the one or more heating elements comprise:

one or more mesh heating elements; and
one or more spiral heating elements.

5. The ceramic vaporizer of claim 2, wherein each of the one or more heating elements comprises:

a first electrical input terminal configured to connect to a first terminal of a power supply of an electronic cigarette; and a second electrical input terminal configured to connect to a second terminal of the power supply of electronic cigarette.

6. The ceramic vaporizer of claim 1, wherein the e-liquid storage device comprises an e-liquid storage tank outside of the exterior surface of the cylindrical vaporizer body.

7. The ceramic vaporizer of claim 1, wherein the e-liquid storage device comprises a cylindrical e-liquid storage medium coaxially positioned outside of the exterior surface of the cylindrical vaporizer body.

8. The ceramic vaporizer of claim 7, wherein the cylindrical e-liquid storage medium comprises at least one of:

cotton fibers;
polypropylene fibers;
terylene fibers;
nylon fibers; and
porous ceramic materials.

9. An electronic cigarette comprising the ceramic vaporizer of claim 1.

10. An electronic cigarette comprising a ceramic vaporizer having:

a cylindrical vaporizer body having an interior surface, and an exterior surface, wherein the interior surface forms a central vapor passage, and the exterior surface forms an inside wall of an e-liquid storage device, wherein the cylindrical vaporizer body extends the entire length of the e-liquid storage device; and a vaporizer heater coaxially positioned in the center of the cylindrical vaporizer body between the interior surface and the exterior surface of the cylindrical vaporizer body.

11. The electronic cigarette of claim 10, wherein the vaporizer heater comprises one or more heating elements configured to heat e-liquid in direct contact with the exterior surface of the cylindrical vaporizer body.

12. The electronic cigarette of claim 11, wherein the one or more heating elements comprise at least one of:

aluminum (Al);
Chromium (Cr);
Manganese (Mn);
Iron (Fe);
Cobalt (Co);
Nickel (Ni);
Copper (Cu);
Zirconium (Zr);
Niobium (Nb);
Molybdenur (Mo);
Rhenium (Re);
Silver (Ag);
Cadmium (Cd);
Tantalum (Ta);
Tungsten (W);
Iridium (Ir);
Platinum (Pt);
Gold (Au); and
alloys thereof.

13. The electronic cigarette of claim 11, wherein the one or more heating elements comprise:

one or more mesh heating elements; and
one or more spiral heating elements.

14. The electronic cigarette of claim 11, wherein the one or more heating elements comprise:

a first electrical input terminal configured to connect to a first terminal of a power supply of an electronic cigarette; and a second electrical input terminal configured to connect to a second terminal of the power supply of electronic cigarette.

15. The electronic cigarette of claim 14, further comprising an air adjustment assembly having:

an air adjustment assembly base having an upper tubular portion threadedly connected to a lower outside threaded portion of the ceramic vaporizer, an air adjustment chamber defined inside of the air adjustment assembly base, and a plurality of first air vents; and an air adjustment ring disposed outside of the upper tubular portion of the air adjustment assembly base, wherein the air adjustment ring comprises a plurality of second air vents, wherein when a user rotates the air adjustment ring around the upper tubular portion of the air adjustment assembly base, and when the locations of the plurality of second air vents of the air adjustment ring match the locations of the plurality of first air vents, air flow from outside to the air adjustment chamber reaches maximum capacity, and when the user further rotates the air adjustment ring around the upper tubular portion, the air flow decreases, and when the locations of the plurality of second air vents of the air adjustment ring completely misalign with the locations of the plurality of first air vents, the air flow stops.

16. The electronic cigarette of claim 15, further comprising an electric connector assembly, wherein the electric connector assembly comprises:

an electric connector base attached to the air adjustment assembly and adapted for connecting the power supply to the one or more heating elements of the ceramic vaporizer, wherein the electric connector base comprises an outer thread configured to electrically connect the first terminal of the power supply of the electronic cigarette to the first electrical input terminal of the one or more heating elements;

an electrode configured to electrically connect the second terminal of the power supply to the second electrical input terminal of the one or more heating elements; and an insulation cover positioned between the electric connector base and the electrode to provide insulation between the first terminal and the second terminal of the power supply of the electronic cigarette.

17. The electronic cigarette of claim 10, wherein the e-liquid storage device comprises a cylindrical e-liquid storage medium coaxially positioned outside of the exterior surface of the cylindrical vaporizer body, wherein the cylindrical e-liquid storage medium comprises:

cotton fibers;

polypropylene fibers;

terylene fibers;

nylon fibers; and porous ceramic materials.

18. The electronic cigarette of claim 10, further comprising a mouthpiece assembly having:

a mouthpiece having a hollow center air passage connected to the central vapor passage of the ceramic vaporizer and configured to provide vaporized e-liquid to a user;

a mouthpiece connector having a threaded lower portion threadedly connected to a ceramic vaporizer body support; and a mouthpiece sealing ring configured to prevent the vaporized e-liquid to leak from the mouthpiece connector.

* * * * *